US010998149B2

(12) United States Patent
Fujino et al.

(10) Patent No.: US 10,998,149 B2
(45) Date of Patent: May 4, 2021

(54) KEY SWITCH

(71) Applicant: Omron Corporation, Kyoto (JP)

(72) Inventors: Hiroaki Fujino, Okayama (JP); Kazuhira Izawa, Okayama (JP); Junichi Seto, Okayama (JP); Mamiko Naka, Okayama (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 16/643,313

(22) PCT Filed: Jun. 20, 2018

(86) PCT No.: PCT/JP2018/023477
§ 371 (c)(1),
(2) Date: Feb. 28, 2020

(87) PCT Pub. No.: WO2019/044130
PCT Pub. Date: Mar. 7, 2019

(65) Prior Publication Data

US 2020/0402739 A1 Dec. 24, 2020

(30) Foreign Application Priority Data

Sep. 1, 2017 (JP) ..... JP2017-168726

(51) Int. Cl.
*H01H 13/14* (2006.01)
*H01H 13/02* (2006.01)
*H01H 13/28* (2006.01)

(52) U.S. Cl.
CPC ..... *H01H 13/14* (2013.01); *H01H 13/023* (2013.01); *H01H 13/28* (2013.01); *H01H 2235/01* (2013.01)

(58) Field of Classification Search
CPC ..... H01H 13/14; H01H 13/023; H01H 13/28; H01H 13/79; H01H 2235/01
See application file for complete search history.

(56) References Cited

U.S. PATENT DOCUMENTS 4,733,036 A * 3/1988 Koizumi ..... H01H 13/705 200/276.1
5,173,578 A * 12/1992 Tama ..... H01H 13/705 200/250

(Continued)

FOREIGN PATENT DOCUMENTS

CN 204155810 U 2/2015
CN 104851727 A 8/2015

(Continued)

OTHER PUBLICATIONS

International Search Report for corresponding International Application No. PCT/JP2018/023477, dated Sep. 18, 2018 (2 pages).

(Continued)

*Primary Examiner* — Kyung S Lee
(74) *Attorney, Agent, or Firm* — Osha Bergman Watanabe & Burton LLP

(57) ABSTRACT

The key switch includes, a base, a button attached to the base so as to be capable of coming into contact with the base and separating from the base, and a coil spring disposed between the base and the button for urging the button in a direction separating from the base. The coil spring has at least an end turn portion formed at one end, a densely wound portion that is continuous with the end turn portion and compressed in an initial state in which the button is attached to the base so that adjacent windings come into contact with each other, and a coarsely wound portion which is continuous with the densely wound portion and in which a winding pitch is larger than that of the densely wound portion, and in the initial state, adjacent windings are separated from each other.

7 Claims, 11 Drawing Sheets

(56) References Cited

U.S. PATENT DOCUMENTS

| | | | | |
|---|---|---|---|---|
| 6,239,393 | B1 * | 5/2001 | Hansen | F16F 1/08 200/276 |
| 7,579,569 | B2 * | 8/2009 | Romanowski | H03K 17/962 200/600 |
| 10,032,576 | B2 * | 7/2018 | Schmelzle | H01H 13/64 |
| 2014/0198476 | A1 | 7/2014 | Ikeuchi | |
| 2015/0043192 | A1 * | 2/2015 | Tanoue | H01H 13/023 362/23.03 |
| 2017/0295269 | A1 | 10/2017 | Hosoi et al. | |

FOREIGN PATENT DOCUMENTS

| | | | |
|---|---|---|---|
| JP | S61-29023 | A | 2/1986 |
| JP | S61-48524 | U | 4/1986 |
| TW | 201506975 | A | 2/2015 |
| TW | 201637458 | A | 10/2016 |
| WO | 96/23313 | A1 | 8/1996 |

OTHER PUBLICATIONS

Written Opinion for corresponding International Application No. PCT/JP2018/023477, dated Sep. 18, 2018 (10 pages).
Office Action in counterpart Taiwanese Patent Application dated Dec. 12, 2018 (12 pages).
International Preliminary Report on Patentability from PCT/JP2018/023477 completed on Mar. 3, 2020 (8 pages).

* cited by examiner

KEY SWITCH

TECHNICAL FIELD

The present disclosure relates to a key switch.

BACKGROUND ART

Patent Document 1 discloses a key switch having a configuration in which a cylindrical guidepost is projected from a base, a light guide is guided on the inner diameter side of the guidepost, and a coil spring disposed on the outer diameter side elastically supports a button so as to be capable of being pushed in.

PRIOR ART DOCUMENT

Patent Document

Patent Document 1: CN 104851727 A

SUMMARY OF THE INVENTION

Subjects to be Solved by the Invention

However, when the key switch is adopted for a keyboard or the like and used as an operation key of game software, an operation of flipping the key switch from a state of being pushed is sometimes performed. In this case, the coil spring generates vibration in the push-in direction of the key switch. However, since the key switch does not have a mechanism for suppressing vibration, the vibration is not readily attenuated, which causes abnormal noise.

An object of the present disclosure is to provide a key switch that can attenuate the vibration of a coil spring to be used at an early stage and effectively suppress surging.

Means for Solving the Subjects

One aspect of the key switch of the present disclosure includes: a base; a button attached to the base so as to be capable of coming into contact with the base and separating from the base; and a coil spring disposed between the base and the button for urging the button in a direction separating from the base, in which the coil spring has at least an end turn portion formed at one end, a densely wound portion that is continuous with the end turn portion and compressed in an initial state in which the button is attached to the base so that adjacent windings come into contact with each other, and a coarsely wound portion which is continuous with the densely wound portion and in which a winding pitch is larger than a winding pitch of the densely wound portion, and in the initial state, adjacent windings are separated from each other.

Effects of the Invention

According to the key switch of the above aspect, when the finger is released from the pushed-in button, the coil spring vibrates, but the windings of the densely wound portion collide with the end turn portion, and the windings of the densely wound portion also collide with each other. As a result, the vibration of the coil spring can be attenuated at an early stage, and surging can be effectively suppressed.

MODES FOR CARRYING OUT THE INVENTION

Hereinafter, an embodiment according to the present disclosure will be described with reference to attached drawings.

Figure 1:
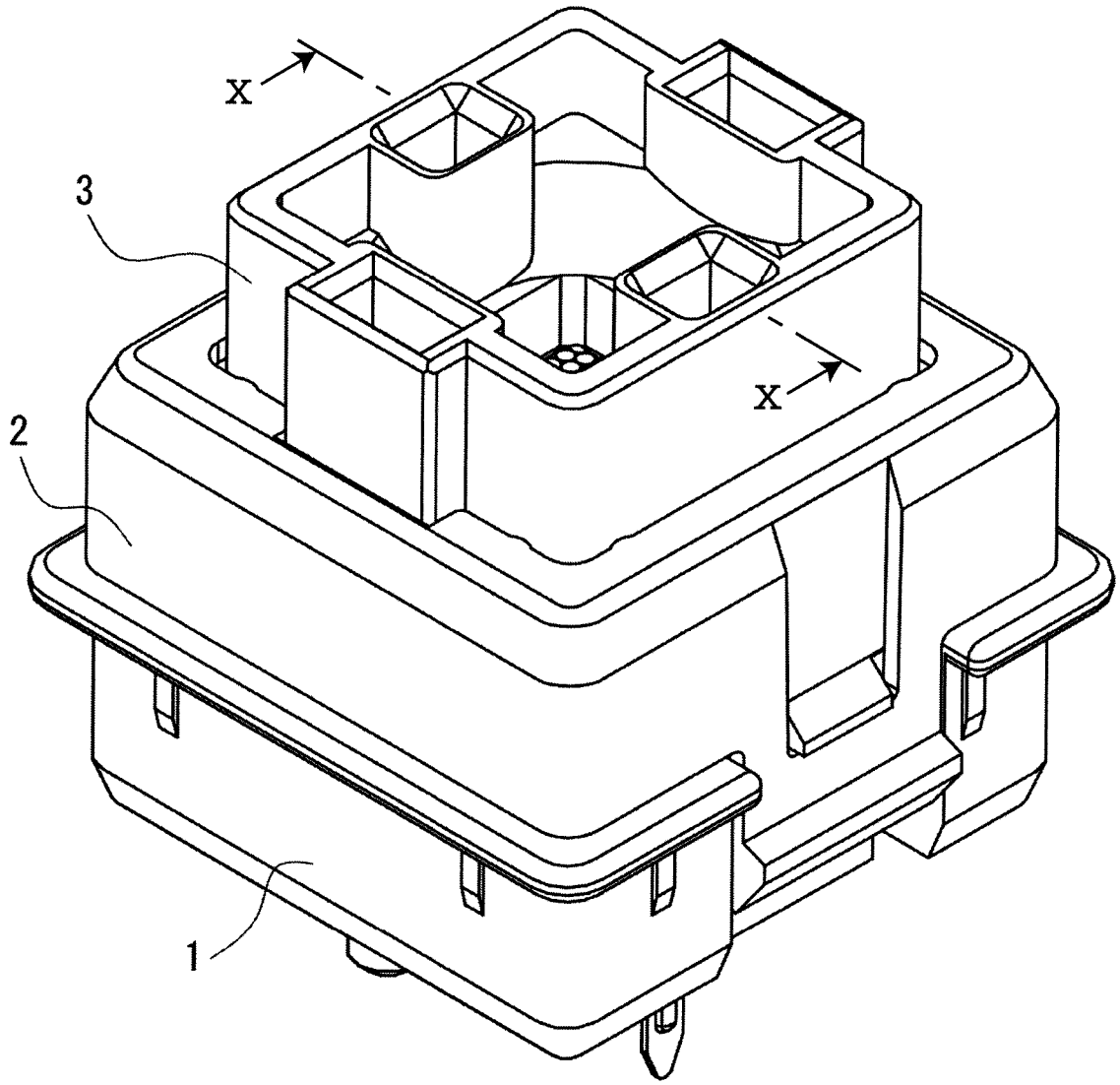
FIG. 1 is a perspective view of a key switch according to the present embodiment.
Figure 2:
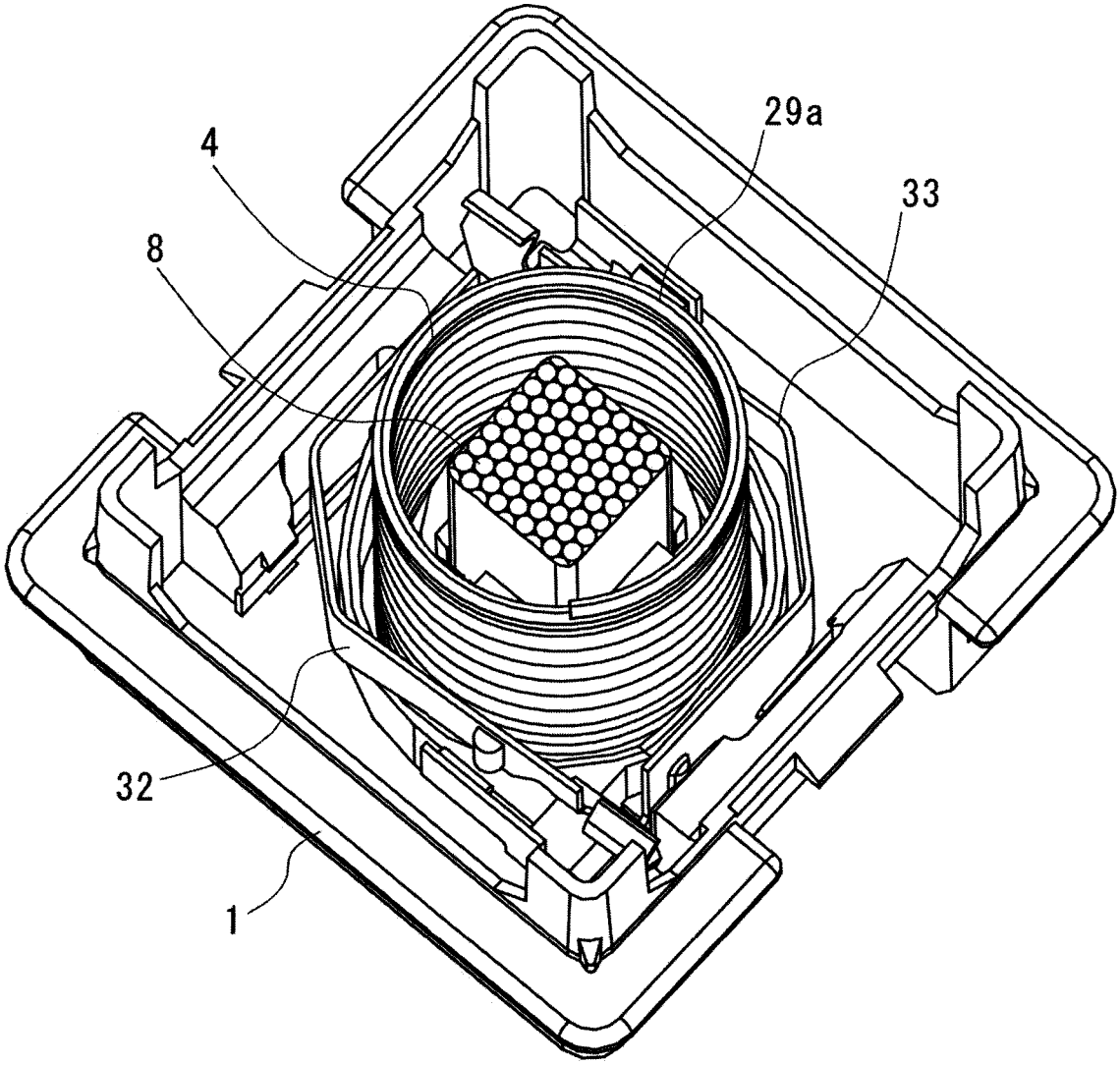
FIG. 2 is a perspective view showing a state where a cover and a button are removed from FIG. 1.
Figure 3:
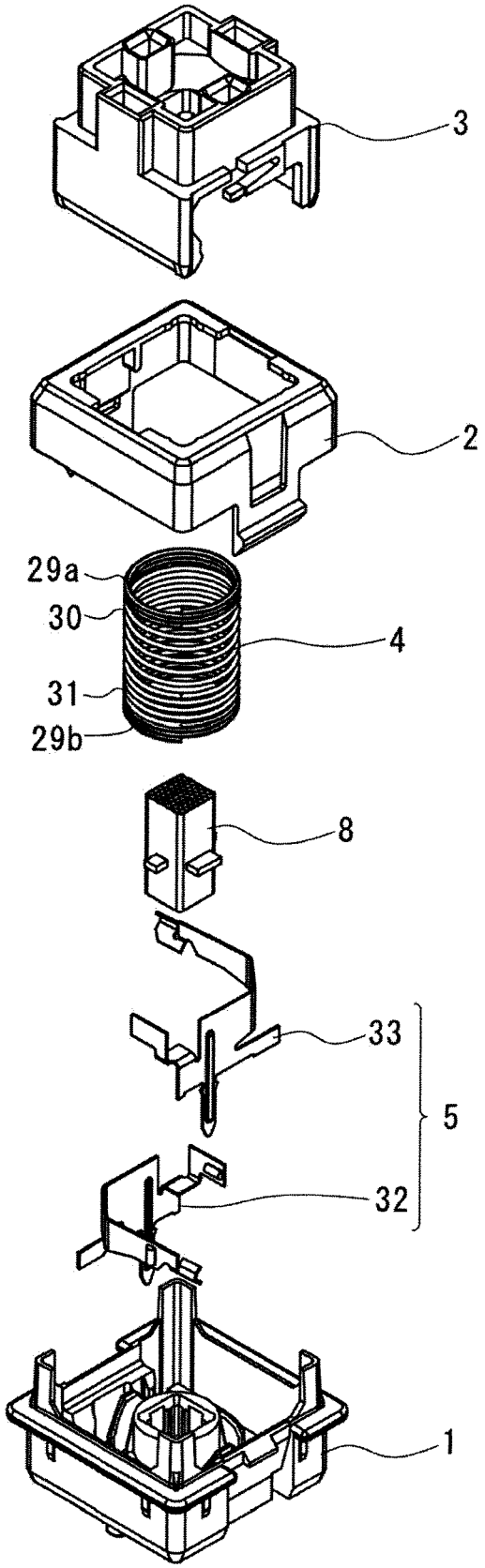
FIG. 3 is an exploded perspective view of the key switch shown in FIG. 1.

FIG. 1 is a perspective view showing the entire key switch according to the present embodiment. FIG. 2 is a perspective view showing a state where a cover 2 and a button 3 are removed from FIG. 1. FIG. 3 is an exploded perspective view of the key switch of FIG. 1. The key switch includes a base 1, a light guide 8, a cover 2, a button 3, a coil spring 4, and a contact switching mechanism 5. The button 3 is attached to the base 1 so as to be capable of approaching thereto or separating therefrom (that is, so as to be capable of coming into contact therewith and separating therefrom).

Figure 4A:
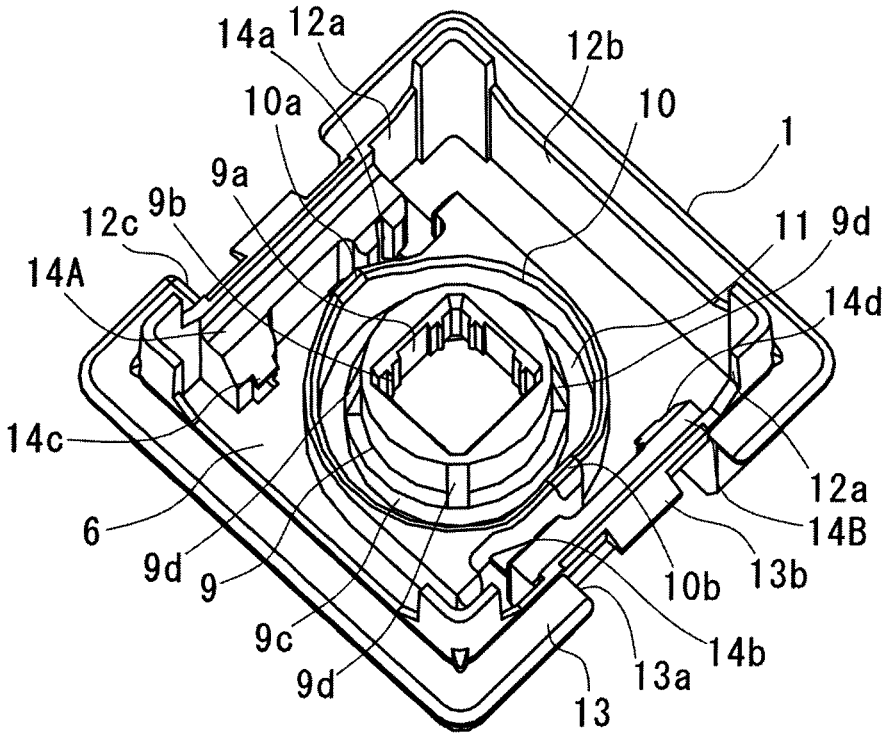
FIG. 4A is a perspective view of a base in FIG. 3.
Figure 4B:
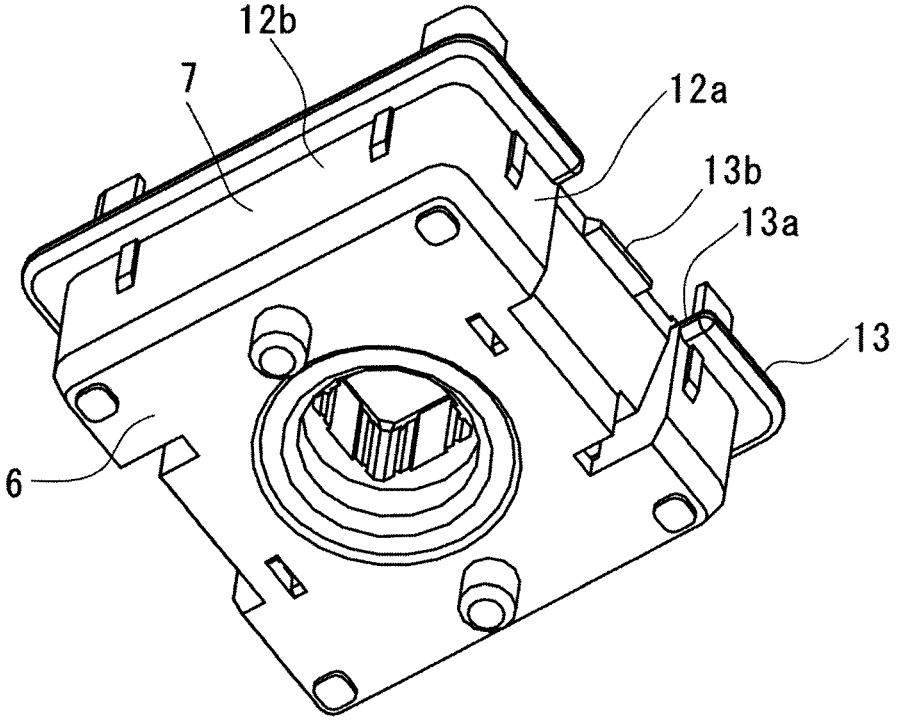
FIG. 4B is a perspective view of FIG. 4A as viewed from below.

As shown in FIGS. 4A and 4B, the base 1 is made of, for example, a synthetic resin material, and has a bottom 6 and a rectangular frame portion 7. A light guide 8 is provided on the bottom 6.

The bottom 6 has a substantially cylindrical guide portion 9 formed at the center. A center hole 9*a* of the guide portion 9 is rectangular in a plan view, and on both sides in the left and right direction of each inner side surface of the center hole 9*a* (that is, the direction parallel to the bottom 6 of the base 1 and the direction perpendicular to a direction in which the button 3 comes into contact with and separates from the base 1), projections 9*b* extending in the vertical direction (that is, the direction perpendicular to the bottom 6 of the base 1 and the direction in which the button 3 comes into contact with and separates from the base 1) are formed, respectively. The light guide 8 described later is press-fitted into the center hole 9*a*.

At the lower end of the guide portion 9, a substantially cylindrical pedestal portion 9*c* having an outer diameter larger than that of the guide portion 9 is formed. In addition, on the outer peripheral surface of the guide portion 9, four inclined portions 9*d* which gradually expand from the upper end toward the pedestal portion 9*c* are formed equally in the circumferential direction until the outer diameter becomes the same. Thus, a second end turn portion 29*b* at the lower end can be positioned on the outer periphery of the pedestal portion 9*c* while guiding the coil spring 4 described later by the inclined portions 9*d*.

An annular wall 10 is provided on an outer peripheral side of the guide portion 9, and an annular groove 11 is formed between the guide portion 9 and the annular wall 10. The annular wall 10 projects in a substantially triangular shape upward (i.e., the button 3 side) at two diagonal places, and a first projection guide 10*a* and a second projection guide 10*b* extending vertically are formed on the outer peripheral surface thereof, respectively. Parts of contact pieces 32 and 33 described later respectively abut on the first projection guide 10*a* and the second projection guide 10*b*, and the positions of the contact pieces 32 and 33 are regulated.

The rectangular frame portion 7 includes two sets of opposing walls 12*a* and 12*b*. A flange portion 13 is formed on the outer surfaces of the opposing walls 12*a* and 12*b*. A first cut portion 12*c* is formed by cutting off the upper portion of each of the opposing walls 12*a* except for both sides. Also, a second cut portion 13*a* in which a portion of the opposing wall 12*a* slightly inside the cut portion 12*c* is cut is formed in the flange portion 13. The lower side of the second cut portion 13*a* is recessed inward, and a locking protrusion 13*b* is formed at the center of the upper end. A first guide wall 14A and a second guide wall 14B protruding inward are formed on the inner surface of each opposing wall 12*a*. The center portions of the first guide wall 14A and the second guide wall 14B are recessed, and a first guide groove 14*a* and a second guide groove 14*b* extending vertically are formed in the protruding portions on one end side, respectively. In addition, a pair of upper and lower first holding claws 14*c* and a pair of upper and lower second holding claws 14*d* are formed on the protruding portions on the other end sides of the first guide wall 14A and the second guide wall 14B, respectively.

Figure 5:
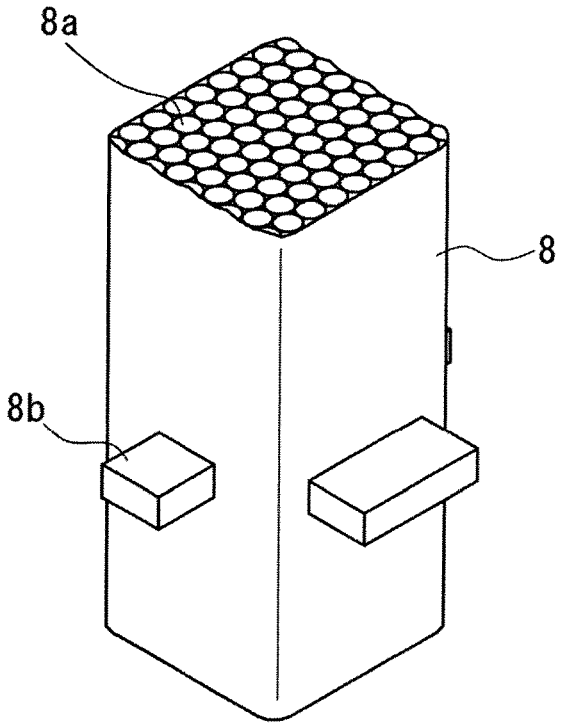
FIG. 5 is a perspective view of a light guide in FIG. 3.

As shown in FIG. 5, the light guide 8 is made of, for example, a synthetic resin material having translucency, and is formed in a substantially rectangular parallelepiped shape as a whole. On the upper surface of the light guide 8, a plurality of convex lenses 8*a* are formed. The light from an LED (Light Emitting Diode) (not shown), which is a light source, is diffused by these convex lenses 8*a*. Further, from the three side surfaces of the light guide 8, flat projecting pieces 8*b* are respectively formed. When the light guide 8 is press-fitted into the center hole 9*a* formed in the guide portion 9 of the base 1, the projecting pieces 8*b* abut on the upper surface of the guide portion 9 to regulate the position in the vertical direction.

Figure 6:
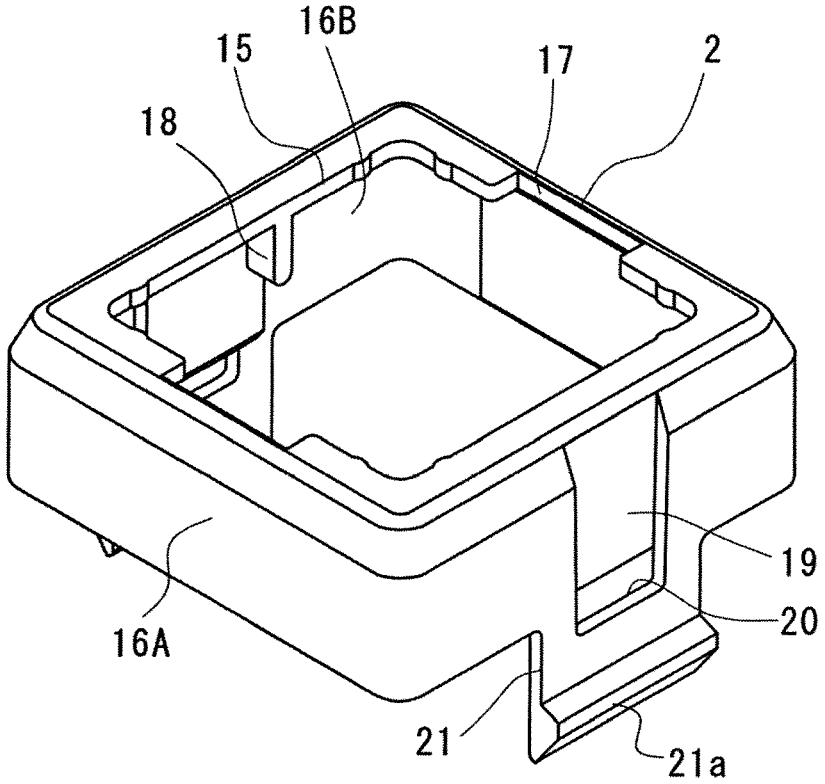
FIG. 6 is a perspective view of the cover in FIG. 3.

As shown in FIG. 6, the cover 2 is made of, for example, a synthetic resin material and has a substantially rectangular frame shape. The cover 2 is composed of two sets of opposing walls 16A and 16B, and flange portions 15 that protrude inward so as to face each other and approach each other are formed at the upper ends of each set of opposing walls 16A and 16B. In the flange portion 15, a notch 17, at which a second locking receiving portion 23*b* of the button 3 described below is located, is formed at a position corresponding to the center of the upper end of one of the opposing walls 16A. Further, the flange portion 15 is formed with a contact receiving piece 18 downward from a position corresponding to the center of the upper end of the other opposing wall 16B. A recess 19 is formed on the outer side surface of the opposing wall 16B downward from the center of the upper end, and a locking hole 20 is provided at the lower end. Further, an extending portion 21 extending further downward is provided at the center of the lower end of the opposing wall 16B, and a protrusion 21*a* is formed on the outer surface of the distal end portion.

Figure 7A:
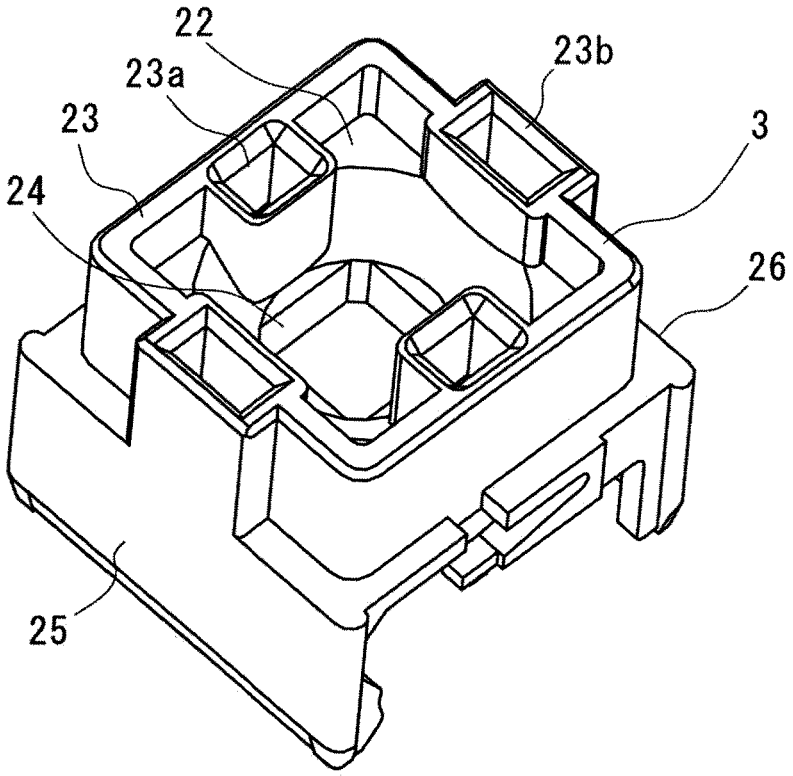
FIG. 7A is a perspective view of the button in FIG. 3 as viewed from above.
Figure 7B:
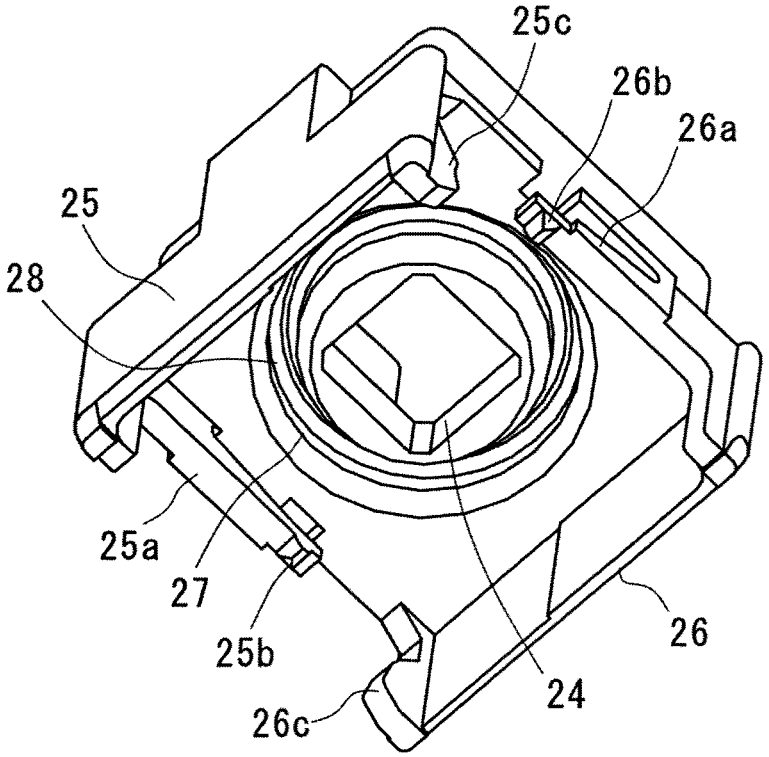
FIG. 7B is a perspective view of the button in FIG. 7A as viewed from below.

As shown in FIGS. 7A and 7B, the button 3 is made of, for example, a synthetic resin material and has a rectangular shape in plan view. The button 3 is divided into an upper half and a lower half with a partition wall 22 interposed therebetween.

The upper half of the button 3 is formed of a substantially rectangular frame 23, and first locking receiving portions 23*a* and second locking receiving portions 23*b* each having a tubular shape are formed at the centers of the opposing side walls, respectively. The first locking receiving portion 23*a* is formed inside the side wall. The second locking receiving portion 23*b* is formed so as to straddle the inside and outside of the side wall. A key cap of a keyboard (not shown) is attached using these locking receiving portions 23*a* and 23*b*. At the center of the partition wall 22, a rectangular opening 24 communicating vertically is formed. The light guide 8 is disposed in the opening 24, and light from an LED (not shown) is applied to the key cap (not shown) via the light guide 8.

In the lower half of the button 3, a first side wall 25, a second side wall 26 facing the first side wall 25, and an annular groove 27 formed around the opening 24 on the lower surface of the partition wall 22 are formed. A first elastic piece 25*a* protrudes from one end of the first side wall 25 toward the second side wall 26. A first locking claw 25*b* is provided at the lower portion of the distal end of the first elastic piece 25*a*. In addition, a first abutting piece 25*c* protrudes from the other end of the first side wall 25 toward the second side wall 26. Similarly to the first side wall 25, the second side wall 26 is also provided with a second elastic piece 26*a* having a second locking claw 26*b* and a second abutting piece 26*c*. A guide cylindrical portion 28 is formed between the annular groove 27 and the opening 24. The annular groove 27 holds an upper end portion of the coil spring 4 described later (that is, a first end turn portion 29*a* described later).

Figure 8:
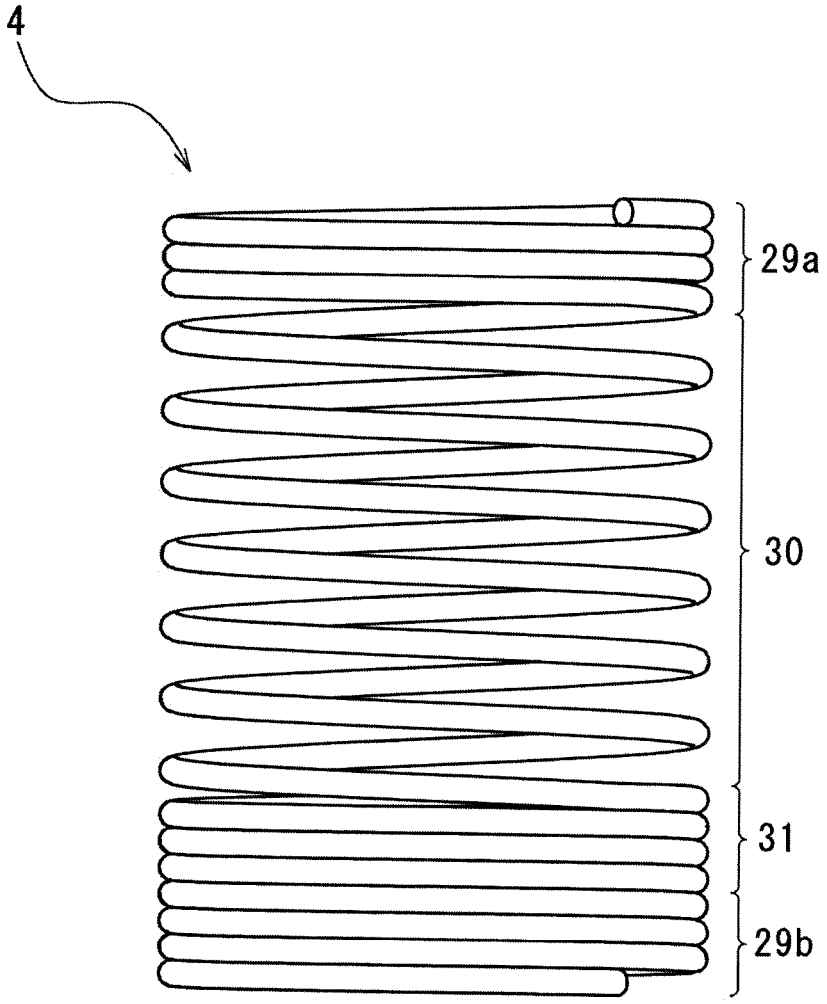
FIG. 8 is a perspective view of a coil spring of FIG. 3.

As shown in FIG. 8, the coil spring 4 is formed of a spiral wire, and has the first end turn portion 29*a* and the second end turn portion 29*b* respectively formed at both ends (that is, both ends in an axial center direction of the coil spring 4) in the vertical direction (that is, the direction in which the button 3 comes into contact with and separates from the base 1). The first end turn portion 29*a* and the second end turn portion 29*b* are portions that apparently do not act as a spring. Here, the first end turn portion 29*a* and the second end turn portion 29*b* are each configured by three windings, but may be configured by two windings or four or more windings. When the first end turn portion 29*a* and the second end turn portion 29*b* are configured by two or more windings, windings are maintained so as to maintain contact with each other without a gap in both the case of compression and the case of expansion.

The first end turn portion 29*a* is followed by the coarsely wound portion 30, and the densely wound portion 31 is provided between the coarsely wound portion 30 and the second end turn portion 29*b*. In an initial state in which the button 3 is not pressed in, the coil spring 4 is slightly compressed between the base 1 and the button 3. The coarsely wound portion 30 is a portion where a gap is formed between adjacent windings in this initial state. The coarsely wound portion 30 is located in a space formed between the base 1 and the button 3. The densely wound portion 31 has a gap formed between adjacent windings in a natural length state in which no compressive force acts on the coil spring 4, but in the initial state, adjacent windings are in contact with each other, and no gap is formed in this portion. The number of turns of the densely wound portion 31 is four, which is the same as the number of turns of the second end turn portion 29*b*. The densely wound portion 31 is disposed in the annular groove 11 of the base 1. When the coil spring 4 has a natural length, there is a relationship of Pz<Pm<Ps when the winding pitch of the first end turn portion 29*a* and the second end turn portion 20*b* is Pz, the winding pitch of the densely wound portion 31 is Pm, and the winding pitch of the coarsely wound portion 30 is Ps. In addition, the pitch of the windings at each portion is equal, but as a whole it is unequal.

When the first end turn portion 29*a* is disposed in the annular groove 27 of the button 3 and the second end turn portion 29*b* is disposed in the annular groove 11 of the base 1, the coil spring 4 with the above-described configuration is disposed between the button 3 and the base 1 and urges the button 3 upward with respect to the base 1. Note that the coil spring 4 may be turned upside down so that the first end turn portion 29*a* is disposed in the annular groove 11 of the base 1 and the second end turn portion 29*b* is disposed in the annular groove 27 of the button 3.

The contact switching mechanism 5 includes a pair of contact pieces, that is, a first contact piece 32 and a second contact piece 33, which are formed by pressing and bending a flat copper alloy.

Figure 9A:
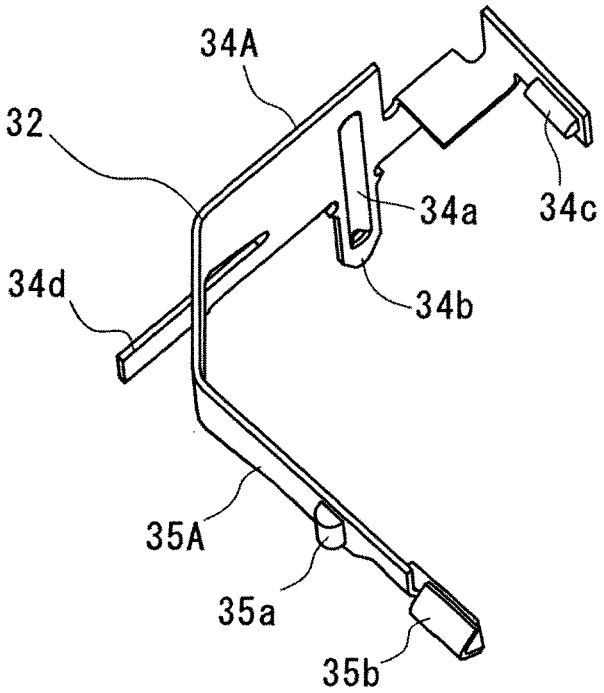
FIG. 9A is a perspective view of a first contact piece of FIG. 3.
Figure 9B:
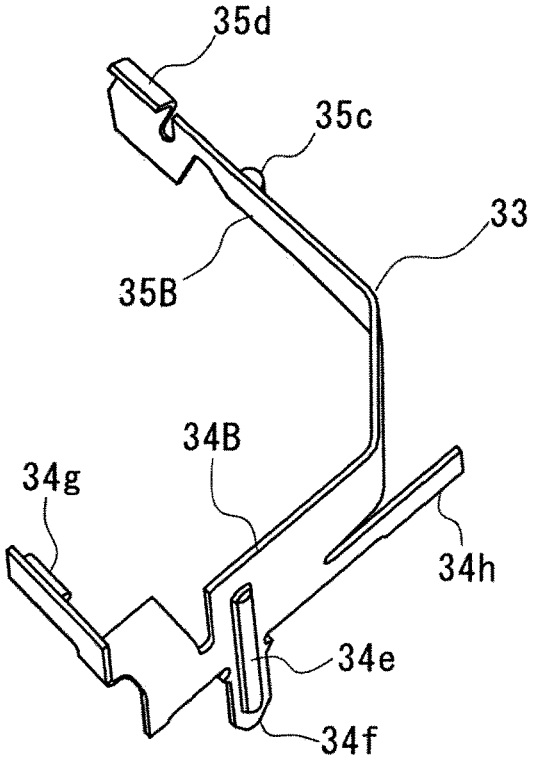
FIG. 9B is a perspective view of a second contact piece of FIG. 3.

As shown in FIGS. 9A and 9B, the first contact piece 32 includes a first fixed piece portion 34A and a first movable piece portion 35A. The first fixed piece portion 34A is formed with a first press-fit portion 34*a* bulging laterally, and a portion protruding downward serves as a first terminal portion 34*b*. One end side of the first fixed piece portion 34A is bent at approximately 90° at two places, and a first fixed contact 34*c* is integrated with the distal end flat surface. The other end side of the first fixed piece portion 34A is a first attached piece 34*d* whose lower half protrudes as it is. The first attached piece 34*d* is held by the first holding claws 14*c* of the base 1. The first movable piece portion 35A is bent downward from the upper half on the other end side of the first fixed piece portion 34A and then extends laterally. A first movable contact 35*a* provided on a side surface and a first press receiving portion 35*b* that is curved and protrudes laterally are formed on the distal end side of the first movable piece portion 35A.

The second contact piece 33 has substantially the same configuration as the first contact piece 32, and includes a second press-fit portion 34*e* corresponding to the first press-fit portion 34*a*, a second terminal portion 34*f* corresponding to the first terminal portion 34*b*, a second fixed contact 34*g* corresponding to the first fixed contact 34*c*, and a second fixed piece portion 34B having a second attached piece 34*h* corresponding to the first attached piece 34*d*. However, the second movable piece portion 35B differs from the first movable piece portion 35A in the extending direction and in that the second movable piece portion 35B extends laterally after going upward from the second fixed piece portion 34B. The second movable contact 35*c* and the second press receiving portion 35*d* are formed on the distal end side of the second movable piece portion 35B in the same manner as the first contact piece 32.

Next, a method of assembling the key switch with the above configuration will be described.

Figure 10:
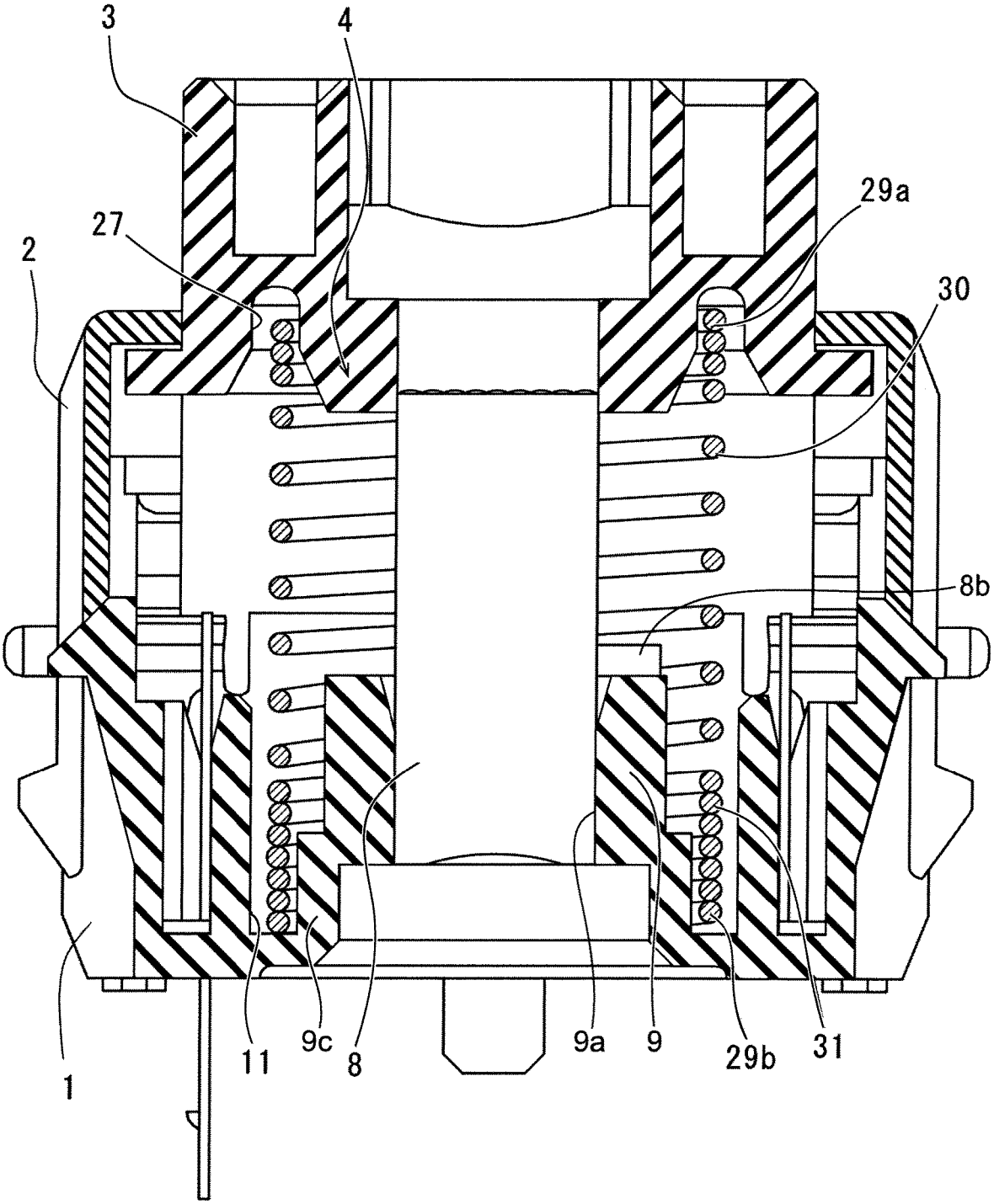
FIG. 10 is a sectional view taken along a line X-X in FIG. 1.

The lower end of the light guide 8 is press-fitted into the center hole 9*a* formed in the guide portion 9 of the base 1. As shown in FIG. 10, the position of the light guide 8 in the vertical direction is regulated by the projecting piece 8*b* formed on the side surface abutting on the upper surface of the guide portion 9. Thus, the base 1 including the light guide 8 is obtained.

The coil spring 4 is disposed on the outer peripheral side of the guide portion 9 of the base 1. The coil spring 4 is disposed on the outer periphery of the pedestal portion 9*c* with the second end turn portion 29*b* guided to the inclined portion 9*d* of the guide portion 9. Therefore, the densely wound portion 31 is located above the pedestal portion 9*c*, the coarsely wound portion 30 is located above the densely wound portion 31, and the first end turn portion 29*a* is located above the coarsely wound portion 30. As described above, the coil spring 4 disposed on the outer peripheral side of the guide portion 9 is disposed at a position where it does not interfere with the light guide 8 attached to the guide portion 9. That is, the coil spring 4 is disposed outside the light guide space formed between the button 3 and the base 1. Therefore, the light emitted from the LED can be applied to the key cap via the light guide 8 without being blocked by the coil spring 4.

The first contact piece 32 and the second contact piece 33 are assembled to the base 1.

In the assembly of the first contact piece 32, the first press-fit portion 34*a* is inserted into the first guide groove 14*a* of the base 1, and the first attached piece 34*d* is held by the first holding claws 14*c*. At this time, the first projection guide 10*a* formed on the annular wall 10 is pressed against the first fixed piece portion 34A of the first contact piece 32. Thereby, the assembled state of the first contact piece 32 to the base 1 is stabilized. The first terminal portion 34*b* protrudes from the lower surface of the base 1.

In the assembly of the second contact piece 33, in the same manner as the first contact piece 32, the second press-fit portion 34*e* is inserted into the second guide groove 14*b* of the base 1, and the second attached piece 34*h* is held by the second holding claws 14*d*. The second projection guide 10*b* formed on the annular wall 10 is pressed against the second fixed piece portion 34B of the second contact piece 33. In this state, the second movable contact 35*c* of the second contact piece 33 closably faces the first fixed contact 34*c* of the first contact piece 32, and the first movable contact 35*a* of the first contact piece 32 closably faces the second fixed contact 34*g* of the second contact piece 33.

The button 3 is placed so as to cover the guide portion 9 of the base 1. At this time, the upper end portion of the coil spring 4, that is, the first end turn portion 29*a* is located in the annular groove 27 of the button 3. Subsequently, the cover 2 is put on the base 1. The cover 2 is attached to the base 1 by locking the locking protrusion 13*b* of the base 1 into the locking hole 20 formed in the extending portion 21. At this time, the first abutting piece 25*c* of the button 3 abuts on the contact receiving piece 18 of the cover 2, and the upward movement of the button 3 is regulated.

The key switch assembled in this manner is used by mounting it on a printed circuit board (not shown) on which LEDs are mounted. At this time, the first terminal portion 34*b* and the second terminal portion 34*f* are inserted and fixed in the terminal holes formed in the printed circuit board. Further, a key cap (not shown) is attached to the button 3 to obtain a keyboard.

Next, the operation of the key switch with the above configuration will be described.

In an initial state in which a key cap (not shown) is not pushed in, the button 3 is urged upward by the coil spring 4 and positioned at the projecting position, as shown in FIG. 10. In this state, the first abutting piece 25*c* of the button 3 abuts on the first press receiving portion 35*b* of the first contact piece 32, elastically deforms the first movable piece portion 35A, and makes the first movable contact 35*a* separate from the second fixed contact 34*g* of the second contact piece 33. Further, the second abutting piece 26*c* of the button abuts on the second press receiving portion 35*d* of the second contact piece 33, elastically deforms the second movable piece portion 35B, and makes the second movable contact 35*c* separate from the first fixed contact 34*c* of the first contact piece 32. Therefore, the first contact piece 32 and the second contact piece 33 are not electrically connected. Further, in the coil spring 4, a gap is formed between the adjacent windings of the coarsely wound portion 30, but the adjacent windings of the densely wound portion 31 are in contact with each other, and a gap is not formed.

When the button 3 is pressed down via the key cap against the urging force of the coil spring 4, the pressed state of the first press receiving portion 35*b* by the first abutting piece 25*c* of the button 3 is released at the first contact piece 32. Further, at the second contact piece 33, the pressed state of the second press receiving portion 35*d* by the second abutting piece 26*c* of the button 3 is released. As a result, the first movable contact 35*a* contacts the second fixed contact 34*g*, and the second movable contact 35*c* contacts the first fixed contact 34*c*. That is, the first contact piece 32 and the second contact piece 33 are electrically connected, and it is possible to detect that a key operation has been performed. At this time, in the coil spring 4, the interval between the adjacent windings in the coarsely wound portion 30 is reduced.

Here, when the pressed state of the key cap is released, the button 3 moves upward by the urging force of the coil spring 4. When the button 3 moves upward, the coil spring 4 vibrates in the axial center direction (that is, the direction in which the button 3 comes into contact with and separates from the base 1). At this time, the state changes from the contact state in which the densely wound portion 31 contacts the adjacent windings to the separated state in which a gap is formed between the windings, and thereafter, the contact state and the separated state are repeated. As a result, the winding of the adjacent densely wound portion 31 collides with the second end turn portion 29*b*. Further, adjacent windings collide with each other also in the densely wound portion 31. Thereby, the elastic energy of the coil spring 4 is rapidly consumed, and the vibration of the coil spring 4 can be attenuated at an early stage. That is, it is possible to suppress the occurrence of surging. Here, although the second end turn portion 29*b* is configured with three windings, the occurrence of surging can be suppressed by configuring the second end turn portion 29*b* with two or more windings.

Note that the present disclosure is not limited to the configuration described in the above embodiment, and various modifications are possible.

Figure 11A:
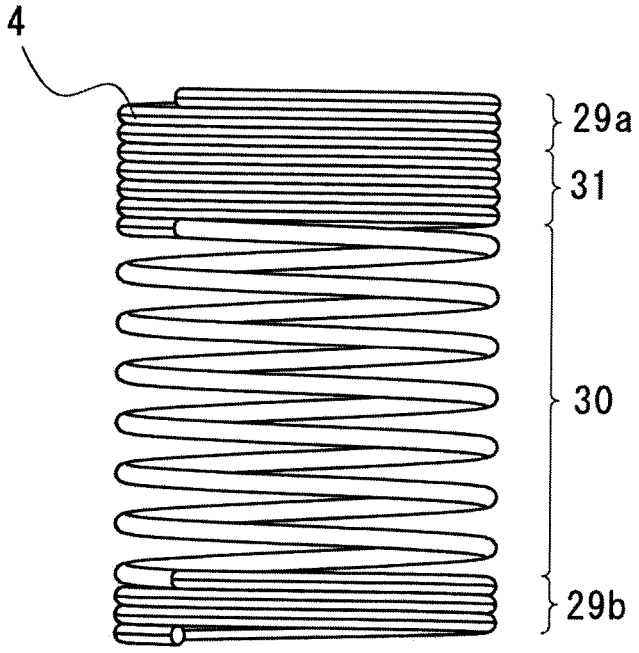
FIG. 11A is a front view of a coil spring according to another embodiment.

In the above embodiment, the coil spring 4 has a configuration in which the densely wound portion 31 is continuous with the second end turn portion 29*b*, but may have a configuration in which the densely wound portion 31 is continuous with the first end turn portion 29*a*. That is, as shown in FIG. 11A, the coil spring 4 may have a configuration in which the first end turn portion 29*a*, the densely wound portion 31, the coarsely wound portion 30, and the second end turn portion 29*b* are connected in this order.

Figure 11B:
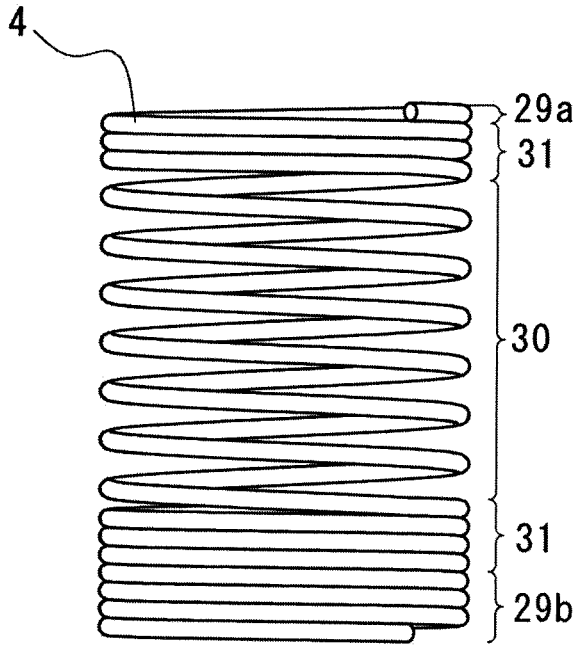
FIG. 11B is a front view of a coil spring according to another embodiment.

Further, it may have a configuration in which the densely wound portion 31 is continuous with each of the first end turn portion 29*a* and the second end turn portion 29*b*. That is, as shown in FIG. 11B, the coil spring 4 may have a configuration in which the first end turn portion 29*a*, the densely wound portion 31, the coarsely wound portion 30, the densely wound portion 31, and the second end turn portion 29*b* are connected in this order.

Figure 11C:
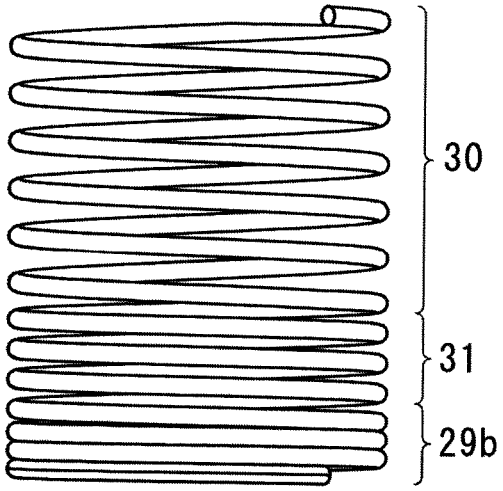
FIG. 11C is a front view of a coil spring according to another embodiment.

Furthermore, it may have a configuration in which an end turn portion is provided only on one end side of the coil spring 4. That is, as shown in FIG. 11C, the coil spring 4 may have a configuration in which the coarsely wound portion 30, the densely wound portion 31, and the second end turn portion 29*b* are connected in this order.

In any case, similarly to the above-described embodiment, surging at the coil spring 4 generated by releasing the pressed state of the key cap and moving the button 3 upward can be suppressed according to the same principle as the above-described embodiment.

As described above, various embodiments of the present disclosure have been described in detail with reference to the drawings. Finally, various aspects of the present disclosure will be described. In the following, description will be given with reference numerals attached as examples.

The key switch according to the first aspect of the present disclosure includes: a base (1); a button (3) attached to the base (1) so as to be capable of coming into contact with the base (1) and separating from the base (1); and a coil spring (4) disposed between the base (1) and the button (3) for urging the button (3) in a direction separating from the base (1), in which the coil spring (4) has at least an end turn portion (29*b*) formed at one end, a densely wound portion (31) that is continuous with the end turn portion (29*b*) and compressed in an initial state in which the button (3) is attached to the base (1) so that adjacent windings come into contact with each other, and a coarsely wound portion (30) which is continuous with the densely wound portion (31) and in which a winding pitch is larger than that of the densely wound portion (31), and in the initial state, adjacent windings are separated from each other.

With this configuration, when the pressed state of the button is released, the button returns to the original position by the urging force of the coil spring. At this time, the coil spring vibrates, but the winding of the densely wound portion adjacent to the end turn portion collides with the end turn portion. Further, the windings of the densely wound portion also collide with each other. Thereby, the elastic energy of the coil spring is consumed, and the vibration is rapidly attenuated. As a result, the occurrence of surging can be suppressed.

In the key switch according to the second aspect of the present disclosure, the coil spring (4) includes an end turn portion (29*a*) at the other end.

In the key switch according to the third aspect of the present disclosure, the coil spring (4) includes a densely wound portion (31) between the end turn portion (29*a*) at the other end and the coarsely wound portion (30).

With this configuration, the elastic energy can be consumed by the collision between the wires also at the other end of the coil spring, similarly to the one end, and the occurrence of surging can be further suppressed by attenuating the vibration.

In the key switch according to the fourth aspect of the present disclosure, the end turn portion (29*a* or 29*b*) formed at one end or the other end of the coil spring (4) is configured by two or more windings.

With this configuration, the occurrence of surging can be further suppressed.

In the key switch according to the fifth aspect of the present disclosure, the number of windings of the end turn portion (29*a* or 29*b*) and the number of windings of the densely wound portion (31) are equal.

With this configuration, the rigidity of the end turn portion and the rigidity of the densely wound portion in a state where the adjacent windings are bonded to each other can be made substantially the same. As a result, the coil spring vibrates and the winding of the densely wound portion collides with the end turn portion, and the windings of the densely wound portion collide with each other, thereby increasing the consumption of elastic energy to further easily attenuate the vibration.

In the key switch according to the sixth aspect of the present disclosure, the end turn portion (29*a*) contacts the button (3).

With this configuration, when the pressed state of the button is released to return the button to the original position by the urging force of the coil spring, the winding of the densely wound portion can first collide with the end turn portion. Therefore, the vibration of the coil spring can be attenuated at an earlier stage.

In the key switch according to the seventh aspect of the present disclosure, the end turn portion (29*b*) is in contact with the base (1).

In the key switch according to the eighth aspect of the present disclosure, the coil spring (4) is disposed outside a light guide space formed between the button (3) and the base (1).

With this configuration, even when the configuration of the coil spring is changed to suppress the occurrence of surging, the illumination state of the key switch can be maintained in a good state because the coil spring does not block light.

In addition, by appropriately combining any of the above-described various embodiments or modifications, it is possible to achieve the effects of the respective embodiments or modifications. In addition, a combination of the embodiments, a combination of the examples, or a combination of the embodiment and the example is possible, and a combination of the features in the different embodiments or the examples is also possible.

Although the present disclosure has been fully described in connection with preferred embodiments with reference to the accompanying drawings, various variations and modifications will be apparent to those skilled in the art. It is to be understood that such variations and modifications are included therein unless they depart from the scope of the present disclosure as set forth in the appended claims.

INDUSTRIAL APPLICABILITY

The key switch according to the present disclosure can be employed for a keyboard or the like.

DESCRIPTION OF REFERENCE SIGNS

1: Base
2: Cover
3: Button
4: Coil spring
5: Contact switching mechanism
6: Bottom
7: Rectangular frame portion
8: Light guide
8*a*: Convex lens
8*b*: Projecting piece
9: Guide portion
9*a*: Center hole
9*b*: Projection
9*c*: Pedestal portion
9*d*: Inclined portion
10: Annular wall
10*a*: First projection guide
10*b*: Second projection guide
11: Annular groove
12*a*, 12*b*: Opposing wall
12*c*: First cut portion
13: Flange portion
13*a*: Second cut portion
13*b*: Locking protrusion
14A: First guide wall
14B: Second guide wall
14*a*: First guide groove
14*b*: Second guide groove
14*c*: First holding claw
14*d*: Second holding claw
15: Flange portion
16A, 16B: Opposing wall
17: Notch
18: Contact receiving piece
19: Recess
20: Locking hole
21: Extending portion
21*a*: Protrusion
22: Partition wall
23: Frame
23*a*: First locking receiving part
23*b*: Second locking receiving portion
24: Opening
25: First side wall
25*a*: First elastic piece
25*b*: First locking claw
25*c*: First abutting piece
26: Second side wall
27: Annular groove
28: Guide cylindrical portion
29*a*: First end turn portion
29*b*: Second end turn portion
30: Coarsely wound portion
31: Densely wound portion
32: First contact piece
33: Second contact piece
34A: First fixed piece portion
34B: Second fixed piece portion
34*a*: First press-fit portion
34*b*: First terminal portion
34*c*: First fixed contact
34*d*: First attached piece
34*e*: Second press-fit portion
34*f*: Second terminal portion
34*g*: Second fixed contact
34*h*: Second attached piece
35A: First movable piece portion
35B: Second movable piece portion
35*a*: First movable contact
35*b*: First press receiving portion
35*c*: Second movable contact
35*d*: Second press receiving portion

The invention claimed is:

1. The key switch comprising:

a base;

a button attached to the base so as to be capable of coming into contact with the base and separating from the base; and a coil spring disposed between the base and the button for urging the button in a direction separating from the base, wherein the coil spring has at least an end turn portion formed at one end, a densely wound portion that is continuous with the end turn portion and compressed in an initial state in which the button is attached to the base so that adjacent windings come into contact with each other, and a coarsely wound portion which is continuous with the densely wound portion and in which a winding pitch is larger than that of the densely wound portion, and in the initial state, adjacent windings are separated from each other, wherein a number of windings of the end turn portion and a number of windings of the densely wound portion are equal.

2. The key switch according to claim 1, wherein the coil spring comprises an end turn portion at other end.

3. The key switch according to claim 2, wherein the coil spring comprises a densely wound portion between the end turn portion at the other end and the coarsely wound portion.

4. The key switch according to claim 1, wherein the end turn portion formed at one end or other end of the coil spring is configured by two or more windings.

5. The key switch according to claim 1, wherein the end turn portion contacts the button.

6. The key switch according to claim 1, wherein the end turn portion is in contact with the base.

7. The key switch according to claim 1, wherein the coil spring is disposed outside a light guide space formed between the button and the base.

* * * * *